United States Patent [19]

Weingärtner

[11] Patent Number: 4,932,384

[45] Date of Patent: Jun. 12, 1990

[54] METHOD OF REGULATING THE FUEL/AIR RATIO OF AN INTERNAL COMBUSTION ENGINE

[75] Inventor: Reiner Weingärtner, Hofheim, Fed. Rep. of Germany

[73] Assignee: VDO Adolf Schindling AG, Frankfurt am Main, Fed. Rep. of Germany

[21] Appl. No.: 303,695

[22] Filed: Jan. 26, 1989

[30] Foreign Application Priority Data

Jan. 28, 1988 [DE] Fed. Rep. of Germany ..... 3802444

[51] Int. Cl.[5] ..... F02D 41/10

[52] U.S. Cl. ..... 123/489; 123/440

[58] Field of Search ..... 123/489, 440, 492; 60/27 C

[56] References Cited

U.S. PATENT DOCUMENTS

| | | | |
|---|---|---|---|
| 4,720,973 | 1/1988 | Katsuno | 60/274 |
| 4,739,740 | 4/1988 | Ohkawara et al. | 123/489 |
| 4,744,345 | 5/1988 | Yamato | 123/489 |
| 4,781,163 | 11/1988 | Jautelat et al. | 123/492 |
| 4,793,312 | 12/1988 | Doinaga et al. | 123/492 |
| 4,819,602 | 4/1989 | Mieno et al. | 123/489 |

*Primary Examiner*—Raymond A. Nelli

*Attorney, Agent, or Firm*—Martin A. Farber

[57] ABSTRACT

A method of regulating the fuel/air ratio of an internal combustion engine, in which the output voltage of an oxygen measurement probe, located in the exhaust pipe of the engine, is used to regulate the fuel/air ratio in the manner that, upon a sudden change of the output voltage of the oxygen measurement probe, a signal jump takes place which is dependent on the direction of the sudden change, followed then by a change, which is substantilly continuous in time, of a correcting variable for the fuel/air ratio. Under substantially steady-state operating conditions the times of the jumps are controlled independently of the sudden changes in the output voltage of the oxygen measurement probe in the manner that the times between the jumps are smaller than the times between previous sudden changes in the output voltage of the oxygen measurement probe.

8 Claims, 4 Drawing Sheets

METHOD OF REGULATING THE FUEL/AIR RATIO OF AN INTERNAL COMBUSTION ENGINE

FIELD AND BACKGROUND OF THE INVENTION

The present invention relates to a method of regulating the fuel/air ratio of an internal combustion engine in which the output voltage of an oxygen measurement probe, located in the exhaust pipe of an internal combustion engine, is used to regulate the fuel/air ratio. The method provides that, upon a change in the output voltage of the oxygen measurement probe, there is a signal jump which is dependent on the direction of signal change and then a variation substantially constant with time of a correcting variable for the fuel/air ratio.

In the known methods of regulating the fuel/air ratio, as a result of the continuous change with time of the correcting variable that fuel/air ratio which leads to a sudden change in the oxygen measurement probe is exceeded in positive or negative direction since a sudden change of the oxygen measurement probe takes place only after the time of travel of the mixture or exhaust gases from the point of injection to the oxygen measurement probe. This leads to deviations from the ideal stoichiometric ratio of lambda=1.

SUMMARY OF THE INVENTION

It is an object of the present invention to make a more accurate regulating of the fuel/air ratio possible.

According to the invention, with substantially steady state operating conditions, the points of time of the jumps are established or controlled independently of the sudden changes of the output voltage of the oxygen measurement probe, in the manner that the times between the jumps are less than the times between prior sudden changes of the output voltage of the oxygen measurement probe. This leads preferably to smaller changes in the fuel/air ratio.

Further according to a feature, the height of the jumps is smaller than the height of the jumps caused by the sudden changes in the output voltage of the oxygen measurement probe.

The method of the invention is suitable for various fuel injection systems, such as, for example, continuously or intermittently injecting systems with central or cylinder injection. Accordingly, the correcting variable given off by the regulator can control the duration of the injection or the pressure of the fuel in the injection system.

A further development of the method of the invention consists therein that during the operation of the regulation it is repeatedly tested whether substantially steady state operating conditions are present, that upon recognition of substantially steady-state operating conditions, the times between successive sudden changes are determined, and that on basis thereof the times of the jumps are controlled independently of the sudden changes which then occur. This feature has the advantage that upon the establishing of the jumps one proceeds from those times between sudden changes of the probe which were ascertained immediately previously.

In accordance with another feature, times between several successive sudden changes are determined and the mean value thereof is formed. In this way, the precision of the times determined is increased.

Another feature of the invention provides that, upon the occurrence of a sudden change before a predetermined time of the control, switching is again effected to regulation of the fuel/air ratio. Since the occurrence of a sudden change before the established jump permits one to conclude that there has been a change in the operating conditions of the engine, rapid adaptation to the new operating conditions is made possible by this feature.

Another feature consists of the fact that, after the expiration of a predetermined period of time, switching is effected to regulation of the fuel/air ratio. This measure prevents the correcting variable from moving gradually away from the correcting variable to be determined by a regulation upon lengthy, substantially steady-state operation.

Finally, another feature resides in the fact that during the time of the control, the correcting variable is gradually shifted in the direction which corresponds to the direction of the last jump of the correcting variable before the start of the control. In this way, one avoids having the correcting variable move away from the optimal lambda value during the period of the control without it being possible to correct this by a corresponding jump in the output voltage of the oxygen measurement probe.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Before describing the invention in detail, it is useful to explain the general principles of the invention. In computer-controlled, automotive fuel-delivery systems, it is the present practice to employ an oxygen sensor located at the engine exhaust to monitor the amount of oxygen present in the exhaust gases. The oxygen sensor outputs an electric signal which may have either a low value or a high value dependent on the concentration of oxygen in the exhaust. One value represents lean and the other value represents rich. This is a relatively crude measurement, indicating only the extreme situations of rich and lean without any indication of more moderate values. In fuel delivery systems of the prior art, computer activity in controlling the air-fuel mixtures has been relatively coarse because the computer would output control signals based only on the extreme values. The computer control was in the nature of a closed-loop feedback system responding to the extreme values of oxygen concentration in the exhaust.

Figure 4:
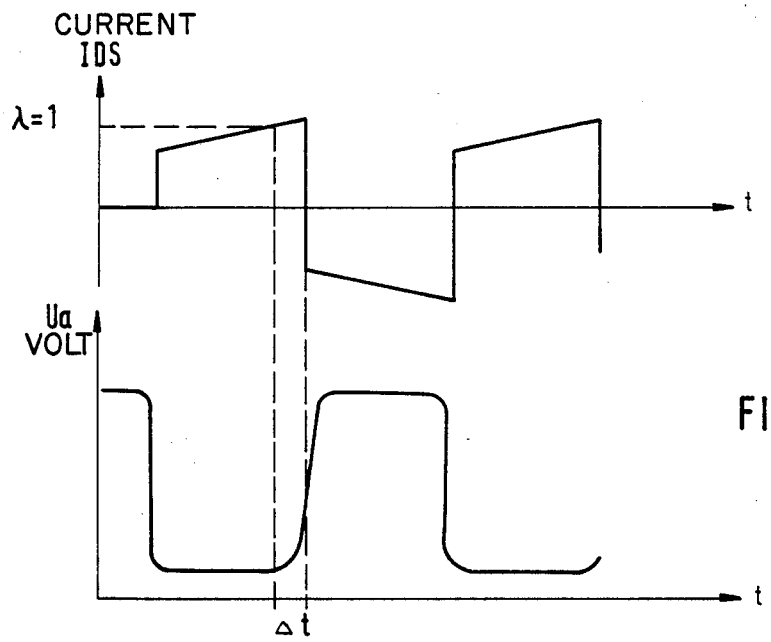
FIG. 4 are time graphs of different variables, which serve to explain the method of the invention.

FIG. 4 shows the computer signals of typical control systems employing feedback based on the extreme values. The computer input signal from the sensor is shown in the lower graph, and the resulting computer output signal is shown in the upper graph. While the graphs indicate a periodic signal for simplicity, in practice the durations of the signal portions vary based on driving factors such as an accelerating engine or changes in load.

The invention achieves a better air-fuel ratio by injecting intelligence into the control system. During steady-state engine operation wherein the sensor output signal is substantially periodic and therefore predictable, the invention provides for interruption of the closed loop control, and inserts momentarily an open-loop control. This is depicted in the upper graph of FIG. 5 wherein the normal closed-loop regulation at the left side of the graph os terminated temporarily at time T1, and a special output signal of the invention is applied to the fuel delivery system until time T3 wherein normal closed-loop operation is resumed. The special output signal of the computer is a pulse train characterized by a significantly reduced undulation and higher repetition frequency than the normal output signal. Control of the fuel delivery by the special output signal of the computer results in a better air-fuel ratio. The means for initiating and terminating the special output signal will be understood from the ensuing description.

Figure 6:
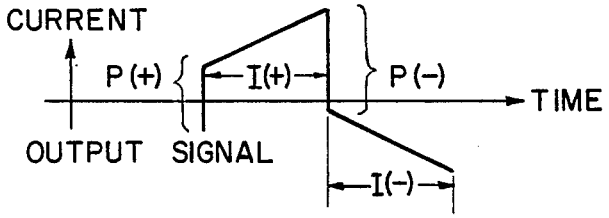
FIGS. 5 and 6 are further time graphs.
Figure 5:
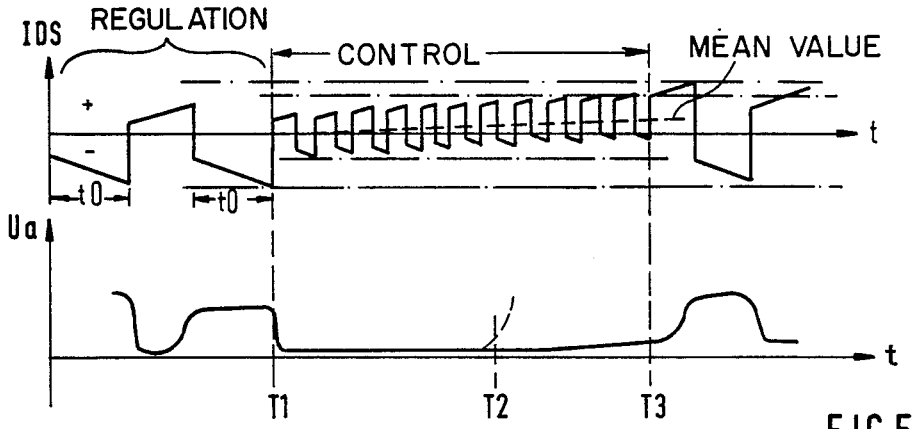

It is noted that the pulse waveform of the special control signal of the invention is similar in waveform to that of the normal regulation signal, as may be seen by inspection of the upper graph of FIG. 5. Both signals are characterized by jumps, or sudden changes, in amplitude at leading and trailing edges of the pulses, and both have ramp portions, the I(+) and the I(−) portions, as depicted in enlarged view in FIG. 6. The leading and/or the trailing edges of the pulses are useful for setting a time, as will be described hereinafter, for generation of the special signal.

Figure 1:
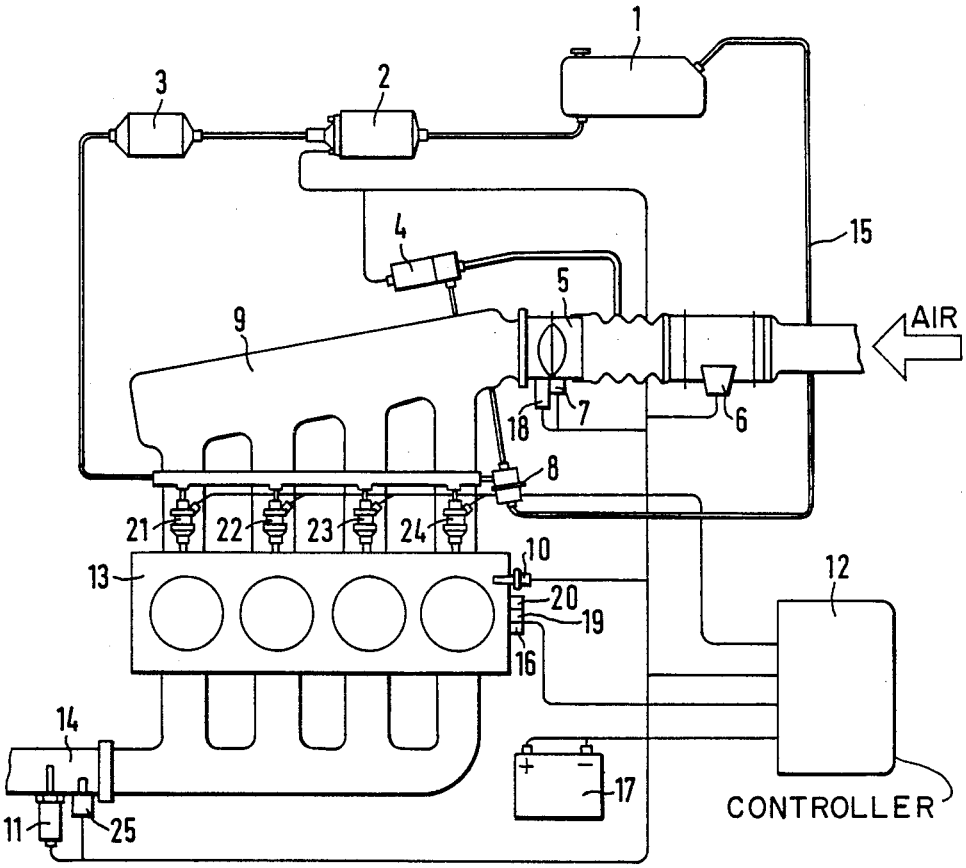
FIG. 1 shows, on basis of a four cylinder engine, a fuel injection system which is suitable for carrying out the method of the invention.

In the fuel injection system shown diagrammatically in FIG. 1, an injection valve 21, 22, 23, 24 is associated with each cylinder of the engine 13. The injection valves are parts of a fuel circuit which consists, in known manner, of a tank 1, an electric fuel pump 2, a fuel filter 3 and a pressure regulator 8 from which the excess fuel is returned into the tank via a conduit 15.

The engine 13 receives the combustion air from an air filter (not shown) via an air-mass meter 6, a throttle valve 5 and the intake pipe 9. The controlling element 4 of an idling-speed regulator is located in a bypass to the throttle valve 5.

In the exhaust pipe 14 of the engine 13 there is an oxygen measurement probe 11 of which an electric output signal is dependent, in known manner, on the oxygen content of the exhaust gases. The temperature of the engine 13 is measured by a cooling-water temperature sensor 10. Furthermore, the engine 13 is provided with a speed-of-rotation transmitter 16, a crankshaft-position transmitter 19 and an ignition-signal transmitter 20. A temperature sensor 25 measures the temperature of the exhaust gas. A switch signal which characterizes the idling position is produced furthermore by a switch 18.

Figure 2:
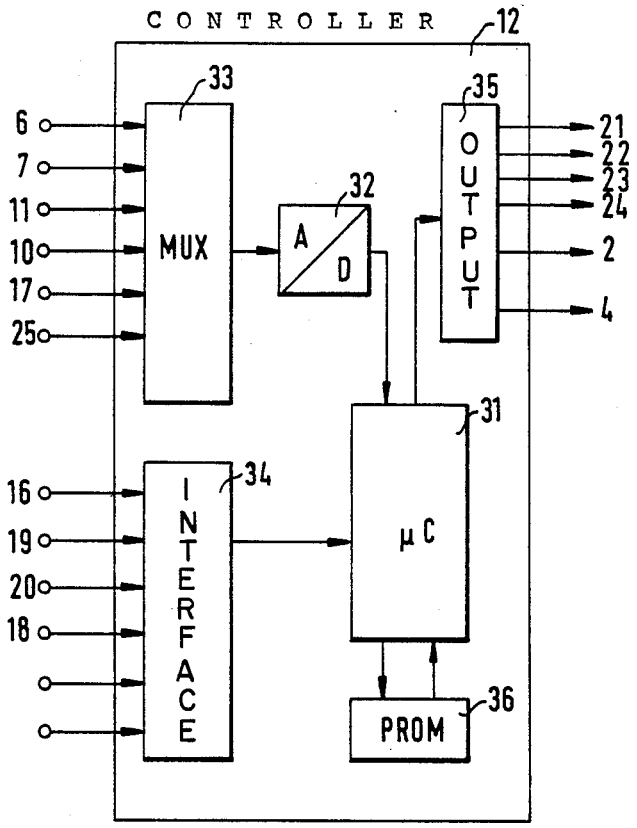
FIG. 2 is a block diagram of a controller of the fuel injection system of FIG. 1.

The position of the throttle valve is transmitted by a transmitter 7, along with signals of the aforementioned sensors and switch 18, to the controller 12. Controllers for the electronic regulating of the fuel injection are know per se, so that in connection with the present invention merely a brief explanation of such a controller will be given with reference to FIG. 2.

Within the controller 12 there is a microcomputer 31 which controls the required functions on basis of an established program. The analog variables are fed via a multiplexer 33 and an analog-to-digital converter 32, while pulse-shaped input variables, in the form of binary signals, pass via interface 34 to the microcomputer 31. Via the interface, the switch signal is also applied to the microcomputer 31. The microcomputer 31 is connected at its output side with power stages 35, there being one power stage for each injection valve and a power stage to control a relay (not shown) for the fuel pump 2 (FIG. 1), as well as a power stage for the controlling element 4 of the idling-speed setter. For the storing of data even when the controller 12 is disconnected, a nonvolatile memory 36, for instance an NV-RAM or NV-PROM, is connected to the microcomputer 31. The microcomputer 31 itself consists, in known manner, of various components not shown, such as a microprocessor, a bus system, a read-only memory for the program and constants, and a write-read memory for variables.

Analog signals from the air-mass meter 6, the throttle-valve-position transmitter (throttle-valve potentiometer) 7, the cooling-water-temperature sensor 10, the oxygen measurement probe 11, the exhaust-gas-temperature sensor 21, and the car electric voltage from a battery 17 are fed to the inputs of the multiplexer 33. The inputs of the interface 34 are connected to the speed-of-rotation transmitter 16, the crankshaft-position transmitter 19, the ignition-signal transmitter 20 and the throttle-valve switch 18.

Figure 3:
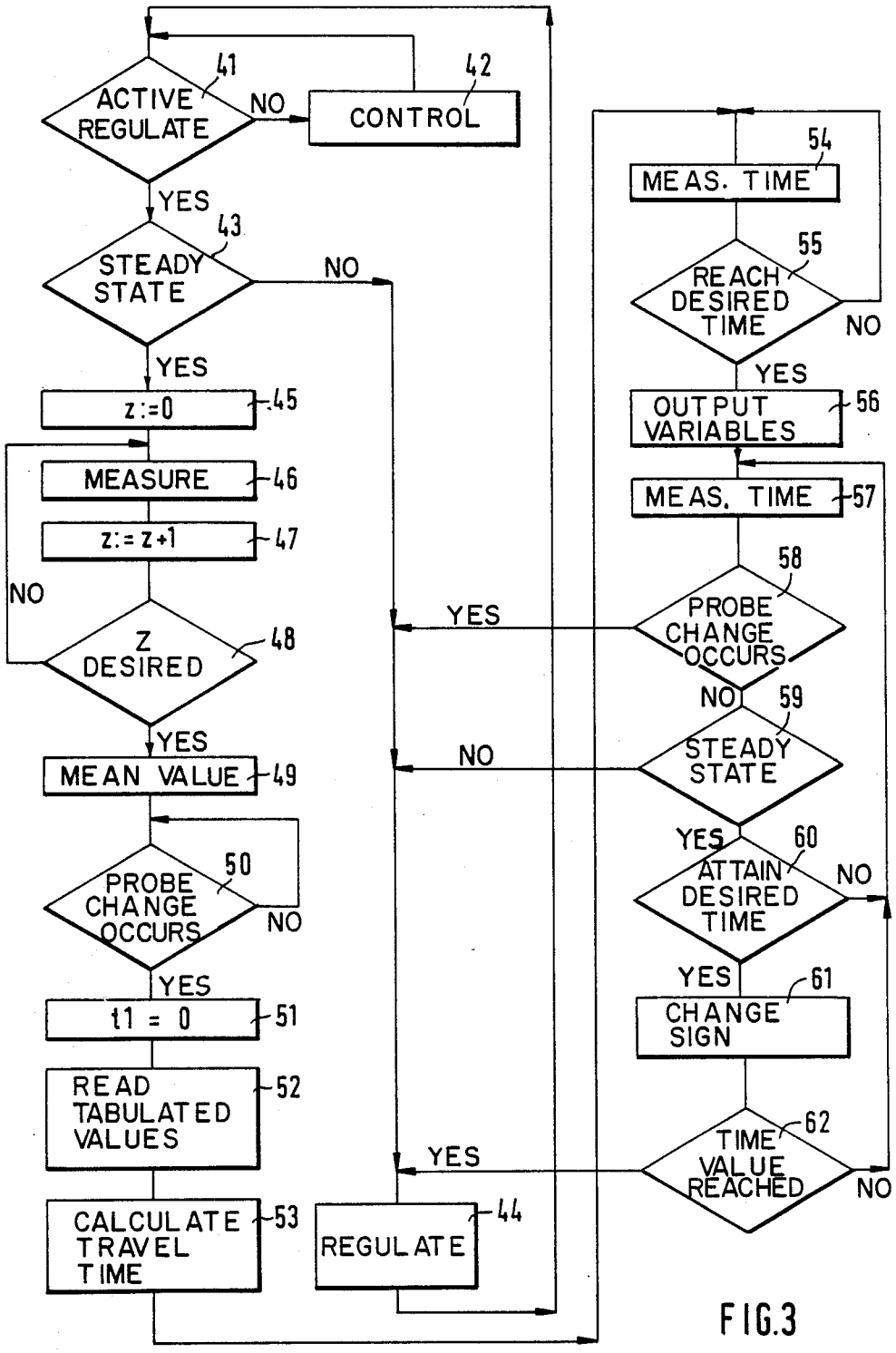
FIG. 3 is a flowchart of a part of the program provided for the microcomputer.

The flowchart of FIG. 3 shows a part of the program for the microcomputer 31. Parts of the program which refer to the known regulation of the fuel/air ratio and possibly other regulating and monitoring tasks have not been shown. The part of the program shown in FIG. 3 contains, first of all, a branching 41, depending on whether regulation of the fuel/air ratio is active or not. The branching 41 is part of a closed loop for action control of lambda. If not-for instance if the oxygen measurement probe is not ready for operation-switching is effected to a control 42, operative in open-loop fashion. However, if the regulation is active then it is tested at 43 whether substantially steady-state operating conditions are present. For this purpose, the change with time of the engine load and the speed (RPM) of engine rotation n is measured and compared with predetermined limit values of load and RPM. If substantially steady-state operation is not present, then the customary regulating of the fuel/air ratio is carried out at 44. Block 44 is closed-loop control of lambda.

In the event of substantially steady-state operation, a count z of a counting process is set to 0 at 45 after the branching 43. The travel time $t_o$ of an integrator is then measured at 46 and the count z is incremented at 47. This is repeated until the count z has reached a desired value "z desired". After the branching 48, the mean value $t_m$ of the travel times $t_o$ measured at 46 is determined in the program part 49.

At the following branching 50, wherein the exhaust oxygen (lambda) produces an output probe signal which can vary from rich to lean or from lean to rich, a waiting loop is formed which produces a delay in the running of the program until the next sudden change in the probe. Thereupon a time count $t_2$ is set to 0 at 51. Values of P and I are employed wherein P is the proportional part and I is the integral component in a control system as described in U.S. Pat. No. 4,461,258 issued to Becker, et al on Jul. 24, 1984 and incorporated by reference herein in its entirety. "P" and "I", which are functions of load and engine speed, are explained also graphically in FIG. 6 which shows an output signal of a microcomputer. At 52 a P jump and an I portion are then taken, as a function of the load and speed of rotation n, from a table and fed to the output of the controller 12 with a sign which is opposite to the sign of the preceding sudden change of the probe.

At 53, a desired travel time until the following jump is calculated by the formation of the difference between the travel time $t0_m$ and a value $t_2$ read from another table. The value $t_2$ ia a maximum value established as a function of the load and of the speed of rotation. At 54 the time "$t_{act}$" which has passed since the preceding jump is measured. As long as the time $t_{act}$ is still less than the desired travel time $t_{des}$, the measurement of the $t_{act}$ is repeated after the branching 55. When tact has reached the value of $t_{des}$, then the P jump and the I portion of the correcting variable are reversed in sign at 56, i.e. the P jump and then the I portion are outputted.

At 57, the time tact which has passed in each case since the jump outputted at 56 is measured, whereupon the program branches at 58 depending on whether a probe sudden change is present. In the event of a probe sudden change, switching is effected to the regulation at 44. If no sudden change in the probe is present, a constant output current pattern is maintained. A test is conducted at 59 to determine whether steady-state operating conditions are still present. If not, state operating conditions are still present then the time $t_{act}$ is compared with the time $t_{des}$ at 60 and as long as $t_{act}$ is less than $t_{des}$ the program is repeated at 57.

As soon as $t_{act}$ has reached the value of $t_{des}$., the P jump and the I portion are reversed in sign at 61. The program then branches at 62 depending on whether the time count t1 which was set at 51 has reached the desired value $t_{des}$. As long as this is not the case, the program is repeated at 57. However, if the predetermined time has passed, the program is continued at 44 with ordinary regulation.

FIG. 4 shows time graphs of the correcting variable, or original, outputted by the microcomputer 31 for control of the fuel injection valves 21, 22, 23 and 24 and, therefore, in the event of a pressure correcting variable for the injection system, the current $I_{DS}$ through the correcting variable and the output voltage of the oxygen measurement probe. In the known regulating system there is in each case, upon a sudden change of the probe, a jump of the correcting variable which is followed by a rise or drop in the correcting variable which is substantially linear with time. Because of the above-mentioned travel time, however, the sudden change in the probe takes place only at a time $\Delta t$ after the value $\lambda=1$ has been reached. During this time the I portion continues to increase, which leads to a moving of the actual fuel/air ratio away from the desired value. In the method of the invention during a substantially steady-state of operation, the jump is carried out as previously so that the time during which the fuel/air ratio differs from $\lambda=1$ becomes zero as far as possible. The variable $t_2$ (FIG. 3, reference numeral 53) which was taken from a characteristic diagram is therefore selected in such a manner that as far as possible it corresponds to the time $\Delta t$.

FIG. 5 shows the correcting variable $I_{DS}$ and the output voltage Ua of the oxygen measurement probe on a time scale which is different from that of FIG. 4. Up to the time $T_1$ there is ordinary regulation, the times $t_o$ being measured in each case. In the example shown, only those times which follow a negative jump are measured. The steady operating state present before the time $T_1$ has lasted a while so that, at the time $T_1$, switching is effected from a regulation to a control of the correcting variable $I_{DS}$. For this purpose, the mean value of the times $t_o$ which were previously determined is formed and a shorter section of time set between, in each case, two jumps of the correcting variable $I_{DS}$.

Furthermore, in the embodiment shown in FIG. 5 the height of the jumps is reduced and the jumps in positive direction are selected slightly higher than the jumps in negative direction. In this way, the correcting variable $I_{DS}$ travels in the direction towards a sudden change during the time of the control. One thus avoids that during this time a moving away from the optimal Lambda value takes place without a correction being possible by a jump of the output voltage of the oxygen measurement probe.

In the case of the start of the control with a negative jump of the correcting variable $I_{DS}$, the height of the negative jumps is increased somewhat as compared with the positive jumps, so that the correcting variable then drifts slowly in the nagative direction. As a whole, during the control there is a smaller swing of the fuel/air ratio then upon the regulation, as is indicated in FIG. 5 by horizontal-dash-dot lines. At the latest after the time $t_{1des}$, switching is again effected to the regulation, which is shown in FIG. 5 at the time $T_3$. However, if a jump in the voltage $U_a$ occurs before $T_3$ has been reached, as indicated at $T_2$ in FIG. 5, then the regulation is already activated again.

TRANSLATION OF LEGENDS OF FIGURES

FIGURE 2

34=INTERFACES
35=END STAGES

FIGURE 5

Regulation Control Mean value

FLOWCHART (FIG. 3)

41 Regulation active?
42 Control
43 delta load <GR delta n
44 Regulation
46 Measure t0
49 Form t0m
50 Sudden change in probe?
52 Output P,I:=f(load,n)+/−
53 if T2,=f(load,n) tdes.:=t0m−t2
54 Measure tact
55 Tact ≧tdes.?
56 Output P,I +/−
57 Measure tact
58 Sudden change in probe?
59 delta load delta n <GR?
60 Tact≧tdes.
61 Output P,I+/−
62 T1≧tides.?

I claim:

1. A method of regulating the fuel/air ratio of an internal combustion engine having an oxygen measurement probe located in an exhaust pipe of the engine, and wherein an the output voltage of the probe is used to regulate the fuel/air ratio, and wherein upon a change in an output voltage of the oxygen measurement probe, there is provided a correction signal for the fuel/air ratio, the correction signal comprising a step signal in the direction of the change followed by a ramp signal substantially constant with time; and wherein the method of forming the correcting signal comprises the steps of determining substantially steady-state operating conditions, during steady state, initiating a sequence of signal jumps at points of time controlled independently of sudden changes of the output voltage of the oxygen measurement probe, the duration of signal pulses in the sequence of signal jumps being less than the intervals between shifts in the level of the output voltage of the oxygen measurement probe.

2. The method of regulating the fuel/air ratio of an internal combustion engine according to claim 1, wherein the height of the jumps in the correcting signal is smaller than the height of the jumps caused by shifts in the level of the output voltage of the oxygen measurement probe.

3. The method of regulating the fuel/air ratio of an internal combustion engine according to claim 2, wherein during regulation of the fuel/air ratio, the step of determining steady state is preformed respectively; and wherein upon recognition of substantially steady-state operating conditions, there is a step of determining the intervals between level shifts in the probe voltage, the lengths of the intervals being employed for controlling the times of the jumps.

4. The method of regulating the fuel/air ratio of an internal combustion engine according to claim 1, wherein regulation of the fuel/air ratio, the step of determining steady state is performed respectively; and wherein upon recognition of substantially steady-state operating conditions, there is a step of determining the intervals between level shifts in the probe voltage, the lengths of the intervals being employed for controlling the times of the jumps.

5. The method of regulating the fuel/air ratio of an internal combustion engine according to claim 1, further comprising determining the mean value of intervals between shifts in level of the probe voltage.

6. The method of regulating the fuel/air ratio of an internal combustion engine according to claim 1, wherein upon the occurrence of a shift in probe voltage before a predetermined time, switching is again effected to regulation of the fuel/air ratio.

7. The method of regulating the fuel/air ratio of an internal combustion engine according to claim 1, wherein after the expiration of a predetermined period of time in a sequence of level shifts of the probe voltage, switching is effected to regulation of the fuel/air ratio.

8. The method of regulating the fuel/air ratio of an internal combustion engine according to claim 1, wherein during a sequence of level shifts of the probe voltage, the correcting signal is gradually shifted in the direction which corresponds to the direction of the last jump of the correcting signal before the start of the control.

* * * * *